US005174377A

United States Patent [19]

Kumar

[11] Patent Number: 5,174,377

[45] Date of Patent: Dec. 29, 1992

[54] METHOD FOR OPTIMIZING STEAMFLOOD PERFORMANCE

[75] Inventor: Mridul Kumar, Placentia, Calif.

[73] Assignee: Chevron Research and Technology Company, San Francisco, Calif.

[21] Appl. No.: 586,486

[22] Filed: Sep. 21, 1990

[51] Int. Cl.[5] ..... E21B 43/24; E21B 43/30

[52] U.S. Cl. ..... 166/245; 166/263; 166/272

[58] Field of Search ..... 166/245, 263, 272, 303

[56] References Cited

U.S. PATENT DOCUMENTS

| | | | |
|---|---|---|---|
| 4,060,129 | 11/1977 | Gomaa et al. | 166/252 |
| 4,093,027 | 6/1978 | Gomaa | 166/272 |
| 4,450,911 | 5/1984 | Shu et al. | 166/272 X |
| 4,458,758 | 7/1984 | Hunt, III et al. | 166/272 |
| 4,466,485 | 8/1984 | Shu | 166/272 |
| 4,491,180 | 1/1985 | Brown et al. | 166/272 |
| 4,515,215 | 5/1985 | Hermes et al. | 166/272 |
| 4,620,594 | 11/1986 | Hall | 166/263 |
| 4,759,408 | 7/1988 | Buchanan | 166/278 |
| 4,793,415 | 12/1988 | Holmes et al. | 166/263 |

*Primary Examiner*—George A. Suchfield

*Attorney, Agent, or Firm*—W. K. Turner; David J. Power

[57] ABSTRACT

Disclosed is an invention for optimizing recovery of petroleum from a subterranean, petroleum containing formation by improving the efficiency of a steam drive through a linear heat reduction schedule and a partial shut-in of the producing well after steam breakthrough. The linear heat reduction schedule and the partial shut-in to compensate for steam override results in maximized discounted net oil recovery with optimal utilization of steam generation capacity.

4 Claims, 8 Drawing Sheets

METHOD FOR OPTIMIZING STEAMFLOOD PERFORMANCE

FIELD OF THE INVENTION

The present invention relates to improving the efficiency of a steam drive in the assisted recovery of hydrocarbons. More particularly it relates to the regulation of heat injection to optimize steamflood performance of a heavy oil reservoir.

BACKGROUND OF THE INVENTION

Steamflood projects are usually operated at a constant injection rate until the economic limit for steam injection is reached. Subsequently, the injection wells are either converted to hot water injection or are shut-in, and production is continued until project termination.

It is now well recognized that steam overrides in heavy oil reservoirs, especially in thick formations and formations having good vertical communication. This condition results from the fact that vapor phase steam, having a lower specific gravity than oil and water present in the pore spaces of the formation, tends to gravitate toward the upper portion of the formation and to sweep out preferentially this upper portion. Once this has occurred, all the subsequently injected steam tends to follow the same path in the upper portion and to exert little sweeping action on the petroleum-saturated lower portions. This is the condition known as steam override. Furthermore, after steam breakthrough, a significant portion of the injected steam is lost through the production wells, thereby drastically reducing steam utilization. Therefore, regulation of the heat injection rate after steam breakthrough can improve both steam utilization and project economics.

Neuman, in his article "A Gravity Override Model for Steamdrive", J. Pet. Tech. January 1985, pages 163–169, and specifically incorporated herein by reference, first proposed an analytical gravity override model for steamflooding, while also deriving an expression for a steam injection schedule to keep the areal extent of the steam zone constant. Vogel, in his article "Simplified Heat Calculations for Steamfloods", J. Pet. Tech. July 1984, pages 1127–1136, simplified Neuman's model and proposed that the heat injection rate should be sufficient to maintain the rate of vertical steam zone growth and to provide for heat losses. Both the Neuman and Vogel models, however, are essentially heat balance models, thereby limiting their ability to predict oil production rates, and providing no guidelines for an optimum injection schedule.

Additionally, methods to overcome the steam-override condition have been proposed which force steam low into the formation thereby improving vertical conformance. One such method is disclosed in U.S. Pat. No. 4,620,594 to Hall, specifically incorporated herein by reference, which suggests a three dimensional blocking action to obstruct fluid flow within the formation, not merely flow between the formation and the producing well.

SUMMARY OF THE INVENTION

The present invention provides a method for optimizing steamflood performance by maximizing discounted net oil recovery with better-utilization of steam generation capacity. Using a confined five-spot pattern, a linear heat reduction schedule is created whose endpoints are determined by the steam breakthrough period at a constant injection rate, and the point at which the Neuman injection rate asymptotically approaches steady state at the estimated project termination period. The negative slope of the straigh: line connection these two points provided the injection reduction schedule for the contemplated project duration. Net oil production for each time interval within this period is calculated based on the difference between gross oil production rate and the fuel rate for generating the injected heat. This net oil production value for each interval is then given a monetary value and discounted at a specified rate to determine an optimum injection schedule. To further optimize steam generation capacity, after steam breakthrough the upper portion, preferably the top 40%, of the producer is shut-in to divert steam to the oil located beneath the override zone, resulting in additional recovery.

While analytical gravity override models for steamflooding, and expressions for steam injection schedules to keep the areal extent of the steamzone constant exist, they are essentially heat balance models and provide no guidelines for an optimum injection schedule. Therefore, it is a principle object of the present invention to provide a method of determining an optimum heat injection schedule related to breakthrough time, which will maximize discounted net oil recovery with optimal utilization of steam generation capacity. A feature of the present invention which enables it to comply with this object is its use of a linearly reduced heat injection schedule and the partial shut-in of the upper portion of the producing well.

DETAILED DESCRIPTION OF THE INVENTION

1. Simulation Model

A simulation model, using a general purpose reservoir simulator as disclosed in SPE paper 18418, "The Formulation of a Thermal Simulation Model in a Vectorized, General Purpose Reservoir Simulator" by Chien, and specifically incorporated by reference herein, was used to model and account for the important physical processes taking place during steamflooding. Utilizing a three phase, three dimensional, fully implicit thermal option, as well as a variety of options for modeling fluid properties and phase behavior, allowed for accurate accounting of steamflood processes.

Figure 1A:
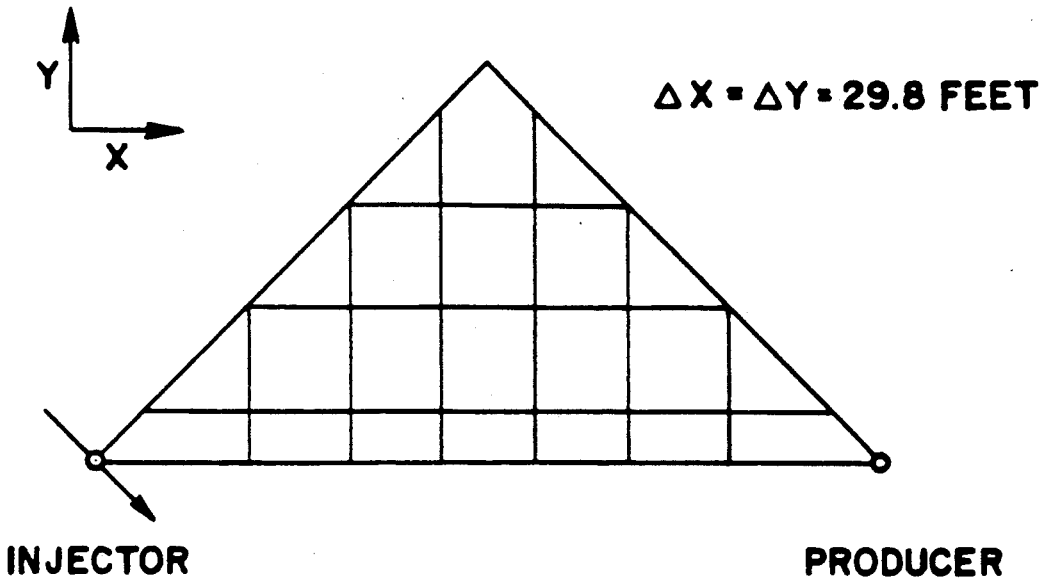
FIGS. 1*a* and 1*b* are a description of the three dimensional model used to represent the symmetric element used in the simulation to define the confined pattern.
Figure 1B:
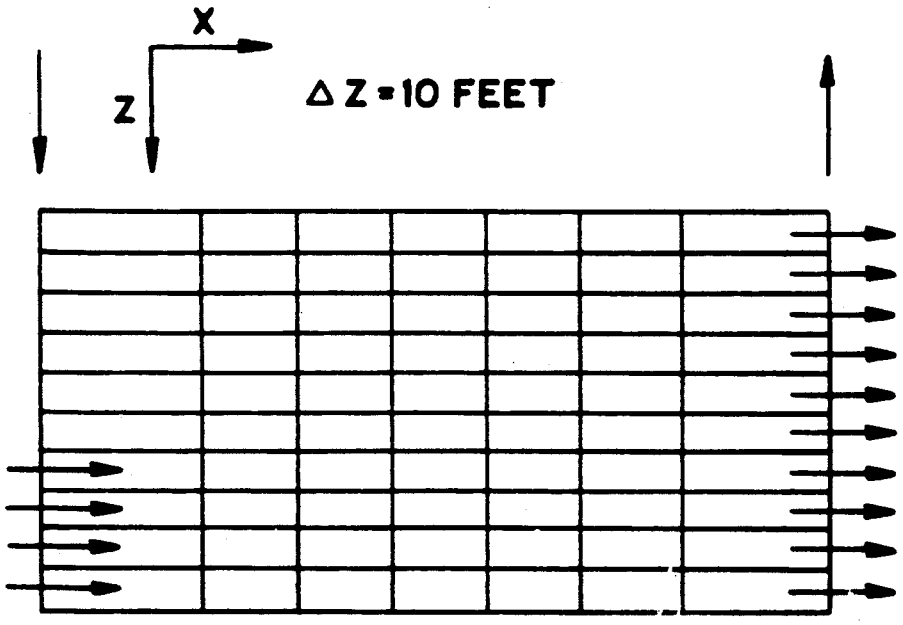

A three dimensional model was used to represent the symmetric element (one-eighth) of a 100-ft. (30.5 m) thick, 2.6 acre (10.560 $m^2$), repeated five-spot pattern. A $7\times4\times10$ parallel grid system was used to represent the confined patterns, as shown in FIG. 1. Apex cells at the three corners of the triangle were combined with similarly adjoining triangles, resulting in a 220-cell model with 22 active grid blocks in each layer. For this grid the injector was open to the bottom four layers, representing 40% of the reservoir thickness;

TABLE 1

| | |
|---|---|
| Model Grid | 7 × 4 × 10 (for ⅛ of a 5-spot) |
| Pattern Area, acres | 2.61 |
| Sand Thickness, ft. | 100 |
| Crude API Gravity, °API | 13 |
| Molecular Weight of Crude Oil | 405 |
| Porosity | 0.31 |
| Horizontal Permeability, md | 4,000 |
| Vertical Permeability, md | 2,000 |
| Initial Reservoir Temperature °F. | 90 |
| Initial Reservoir Pressure, psia | 35 |
| Initial Oil Saturation | 0.52 |
| Initial Water Saturation | 0.48 |
| Initial Gas Saturation | 0.00 |
| Oil Compressibility, 1/psi | $5\times10^{-6}$ |
| Rock Compressibility, 1/psi | $50\times10^{-6}$ |
| Reservoir Thermal Conductivity, BTU/D-ft-°F. | 36 |
| Sand Volumetric Heat Capacity, BTU/$ft^3$-°F. | 35 |
| Injection Pressure, psia | 67 |
| Injected Steam Quality | 0.5 |
| Injection Rate, B/D CWE | 390 (for full pattern) |

Table 1 discloses a summary of reservoir and fluid properties used in the simulation model. The reservoir was considered to be homogeneous, thereby allowing the separation of process effects from reservoir geology. The representative porosity and horizontal permeability factors used were 31% and 4,000 (3.94 $\mu m^2$) respectively; while the vertical to horizontal permeability ratio was 0.5. The initial reservoir pressure and temperature factors were 35 psia (0.24 MPa) and 90° F. (32.2° C.) respectively; while initial oil saturation was 52%, with initial water saturation at 48%. Reservoir (pore volume) compressibility was $50\times10^{-6}$ $psi^{-1}$ ($72.5\times10^{-10}$ $Pa^{-1}$), well within the range of actual measurements taken on unconsolidated cores.

The heavy oil was represented by a single component and was assumed to be nonvolatile, having a crude gravity of 13° API (0.91 g/cc) and a molecular weight of 405, with crude oil viscosity as a function of temperature given in Table 2. The initial steam injection rate for the simulation was 390 B/D (62 $m^3$/D) cold water equivalent (CWE) or 1.5 B/D-Ac-ft. ($0.193\times10^{-3}$ $m^3/d-m^3$), with

TABLE 2

| Temperature, °F. | Viscosity, cp |
|---|---|
| 75 | 4,200 |
| 100 | 1,100 |
| 150 | 130 |
| 200 | 33 |
| 250 | 12.5 |
| 300 | 6.4 |
| 350 | 3.8 |
| 400 | 1.6 |

Figure 2A:
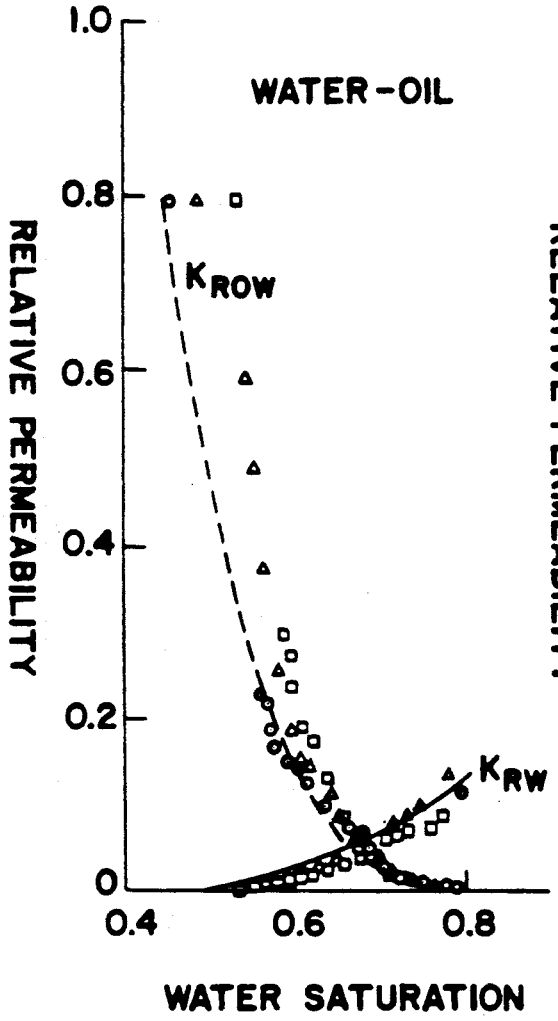
FIGS. 2*a* and 2*b* are the Cory-type functional forms, used to describe the two-phase water-oil and gas-liquid relative permeabilities used in the simulation.
Figure 2B:
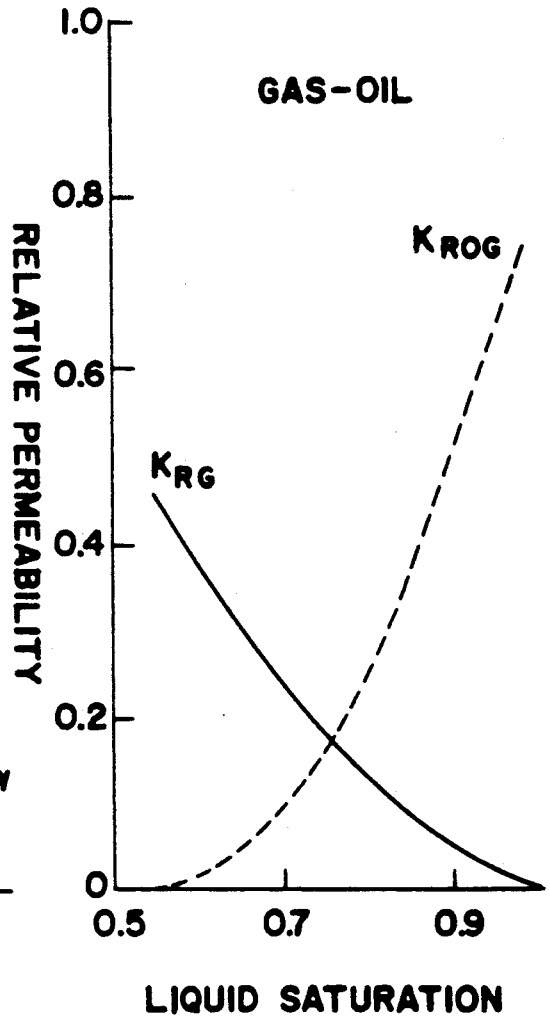

Two-phase water-oil and gas-liquid relative permeabilities for the simulation were obtained using the Cory-type functional form, as detailed in the article "Fourth SPE Comparative Solution Project Comparison of Steam Injection Simulative", J. Pet. Tech. December 1987, pages 1576–1584, incorporated herein and shown in FIG. 2. The exponent for the water and oil curves in FIG. 2 were obtained by a regression fit of actual measured data, and were 2.0 and 3.1 respectively; with the exponent for the gas and liquid curves, being 1.5 and 2.0 respectively.

Endpoint saturations and relative permeabilities were assumed for the simulation to be independent of temperature. Since recent studies, as disclosed in SPE paper 20202 "Effects of Endpoint Saturations and Relative Permeability Models on Predicted Steamflood Performance" incorporated herein, indicated that only vapor displacement occurs during steamflooding of a heavy oil reservoir, the gas-oil relative permeability curves used were assumed to be at steam temperatures. These same studies indicate that temperature-dependent endpoint saturations for water-oil systems have little effect on performance.

The three-phase oil relative permeabilities were calculated using the linear interpolation model disclosed by Baker in SPE publication 17369 entitled "Three-Phase Relative Permeability Correlations" and specifically incorporated herein, since this model is able to give a more accurate prediction of steamflood residual oil saturation.

2. Calculation Procedure

For each injection schedule discussed herein, the discounted cumulative net or saleable oil production, was maximized to determine the optimum injection schedule of the schedules evaluated. The discounted net oil production, in net present barrels (NPB) is given by the equation $$NPB=\Delta N_{pt}/(1+i)^t \quad (1)$$

where, $\Delta N_{pt}$ is the incremental net oil production in a time period; t is the midpoint of that time period; and i is the discount rate. Note that i and t should be in consistent units; i.e., if t is in days, then i should be discount rate per day. The cumulative discounted net oil production is obtained by a summation of NPB's for each incremental period.

The net oil production rate, as defined herein, is the difference between the gross oil production rate minus oil, or equivalent amount of gas, that is used as fuel to generate steam.

$$\text{Net } q_o=\text{Gross } q_o-\text{Fuel Rate} \quad (2)$$

Surface and wellbore heat losses are taken into account in determining the fuel required for steam generation. For the conditions of the simulation, the calculated wellbore heat loss was 4.4% of the heat injection rate at the end of one year; it decreased to 4% at the end of 10 years. It was found that the rate of heat loss remains essentially unchanged with a decrease in wellbore and formation temperatures. Therefore, the rate of heat loss as a fraction of injected heat increases as the injection rate is decreased. As a result, at low injection rates, heat loss is a significant fraction of the injected heat and cannot be neglected. In calculations, the heat loss rate was considered to be 5% of the initial heat injection rate so as to also account for surface losses. The injection rates used in the numerical simulations are at the sand face, while the heat required at the generator was obtained by adding heat losses to this value. Knowing the generator efficiency and heat of combustion of the crude oil, the amount of the oil required as fuel was calculated using the following expression.

$$\text{Fuel Rate} = 350\ \Delta h_s\ (i_s + 0.05\ i_{s,t=0}) / (E_g\ H_c) \quad (3)$$

where, $\Delta h_s$ is steam minus inlet water specific enthalpy; $i_s$ is the steam injection rate at any time; $E_g$ is the generator efficiency; and $H_c$ is the heat of combustion of the crude oil.

Therefore, knowing the steam injection rate, steam enthalpy, and gross oil production rate, the net oil production rate for each schedule can be calculated using Equations (2) and (3). By integrating these equations, the net oil production during any time interval can be determined; with Equation (1) then used to determine the discounted net present barrels of oil produced.

3. Optimum Injection Schedules for Confined Pattern Models

It is well known that a reduction in heat injection rate can be accomplished by either reducing the steam flow rate and keeping quality constant or by varying both rate and quality. Because of its simplicity, and ease of implementation in the field, the preferred method, as disclosed herein, is to vary the heat injection rate by changing steam flow rate while keeping quality constant.

Figure 3:
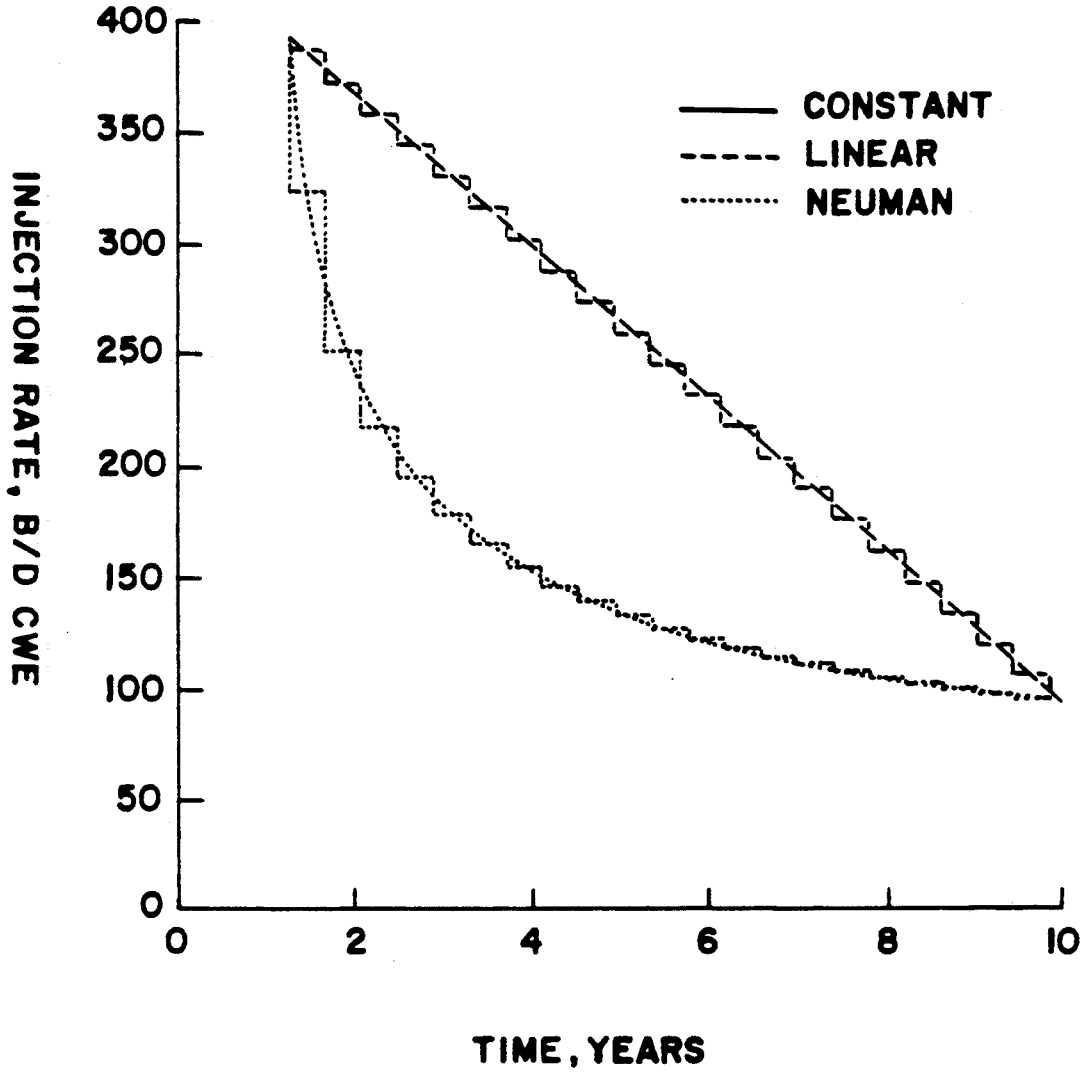
FIG. 3 represents the three types of injection schedules analyzed in the simulation.

Steam injection rates were reduced after steam breakthrough to the production wells, to minimize the amount of steam produced through the producers, thereby improving injected steam utilization and process efficiency. Results for the three injection schedules, namely constant, linear, and Neuman, are shown in FIG. 3. Note that these three cover a broad range of heat reduction schedules. Several other rate reduction schedules based on a power-law function were also considered; however, their results can be approximated by one of the three schedules shown in FIG. 3.

The constant injection schedule is commonly used in the field. Neuman's schedule, based on his analytical model, would arrest areal growth of steam zone. However, Neuman's model predicts severe initial rate reduction as shown in FIG. 3. As shown later, this results in significant initial production rate decline, which may not be desirable. The linear reduction schedule is more gradual than Neuman's. In simulation, a stair-step injection schedule with a 150-day time interval was used to represent continuous rate reduction functions.

Figure 4:
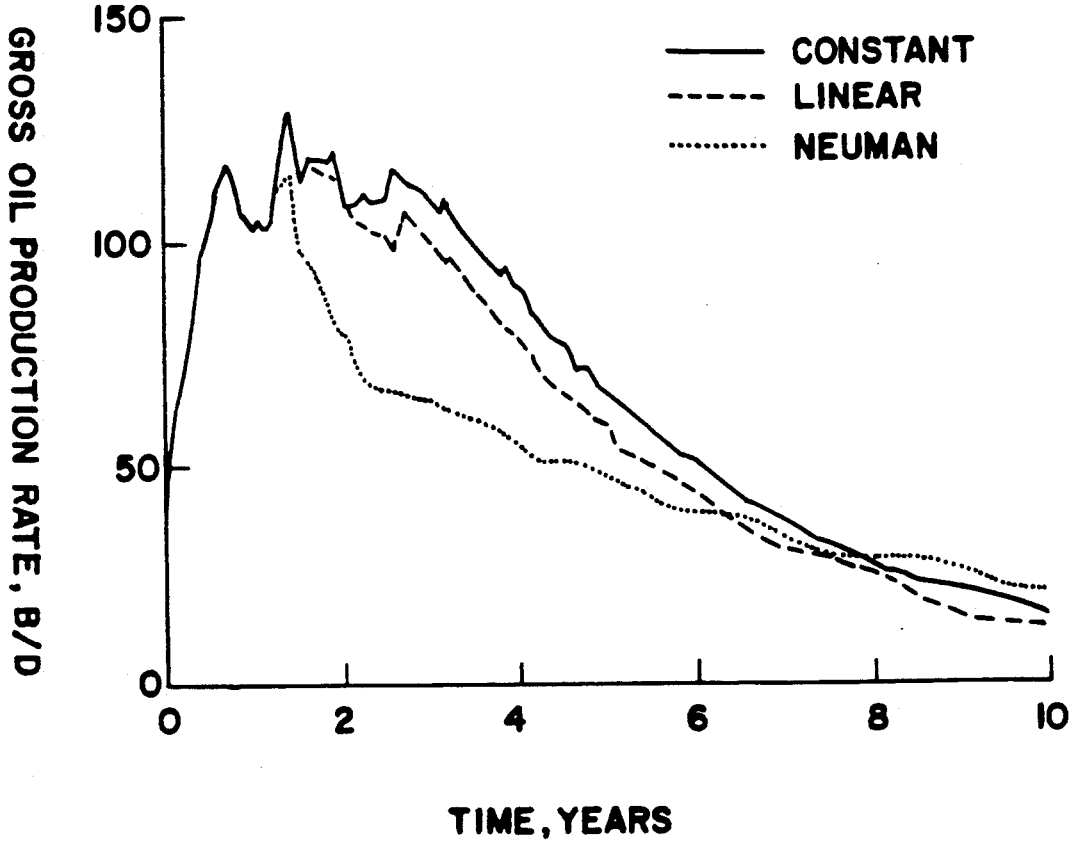
FIG. 4 describes gross oil production at each injection schedule.

FIG. 4 shows that the gross oil production rate declines as the injection rate is reduced. The decline in oil production rate is most severe for the Neuman's model because the injection rate is reduced by about 45% within one year of steam breakthrough for this model. The linear model shows a relatively small decrease in the gross oil production rate. The decrease in oil production rate is a result of lower reservoir pressure with lower injection rates. For a flat reservoir, even though most of the reservoir heating occurs from the top by the overlying steam zone, higher reservoir pressure provides the horizontal pressure gradient needed to overcome viscous forces and produce the heated oil.

Figure 5A:
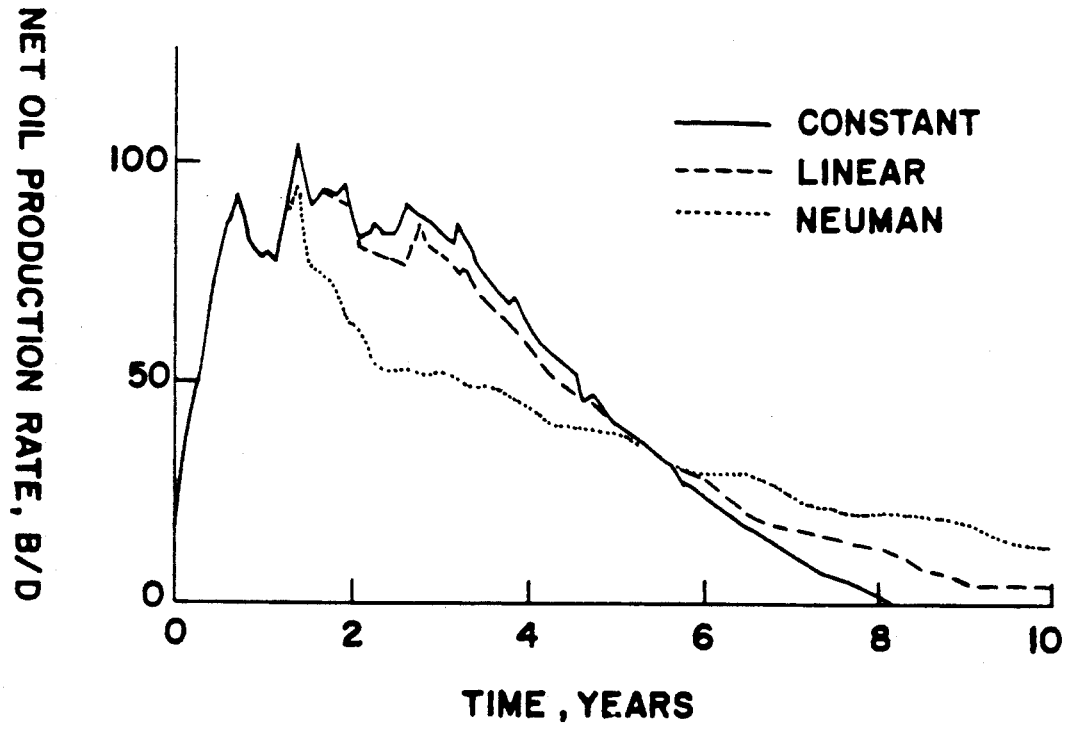
FIGS. 5*a* and 5*b* describe net saleable oil production and cumulative net oil production for each injection schedule.
Figure 5B:
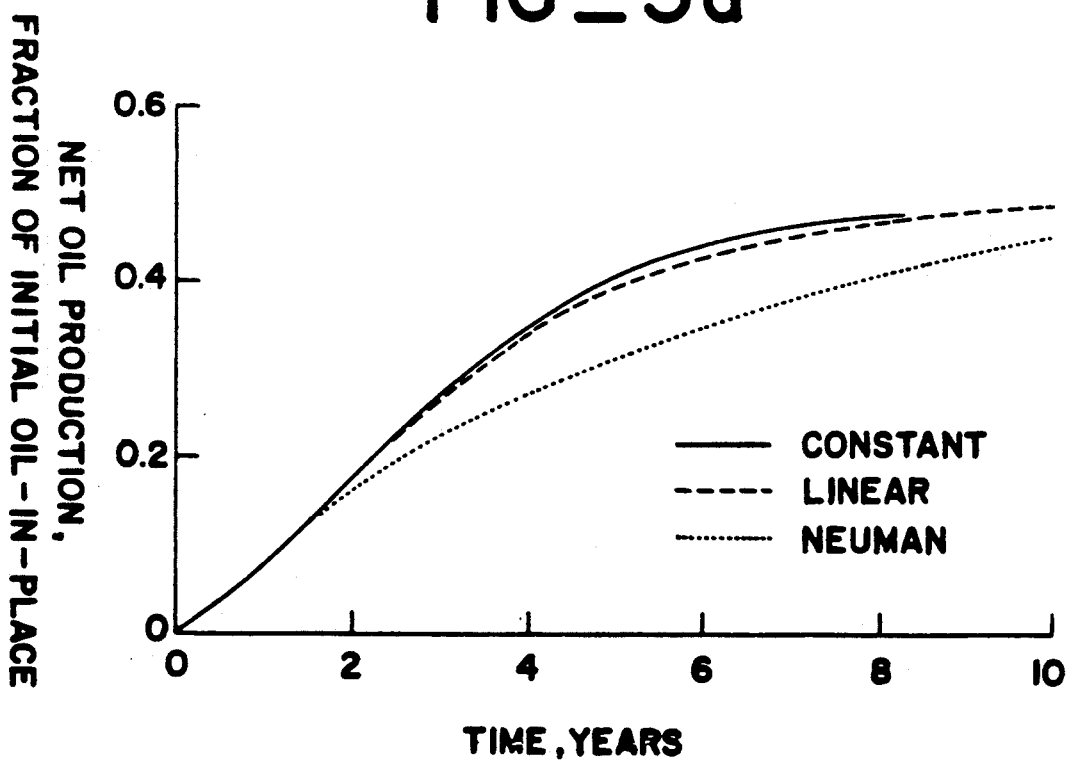

FIG. 5 shows that the beneficial effect of rate reduction is in the net of saleable oil production, especially later in the life of the project. Reduction in the oil production rates as shown in FIG. 4, for the linear and Neuman schedules are offset by their lower fuel requirements. Also, it is established that the oil production is delayed when the injection rate is reduced.

FIG. 5 also shows that the cumulative net oil production is the highest for the linear model. The constant injection schedule was stopped when its net oil production rate became zero. After eight years, constant injection schedule would have a net oil production rate of less than zero because the fuel required to generate steam would exceed the produced oil. Note that this may not be easy to interpret in the field, especially when the wells are completed into multiple sands or when the adjacent patterns were areally expanded.

TABLE 3

| Injection Schedule | Discount Rate 0% | 5% | 10% |
|---|---|---|---|
| Constant | 19,290 | 16,780 | 14,690 |
| Linear | 19,770 | 16,960 | 14,690 |
| Neuman | 18,360 | 15,410 | 13,120 |

The linear heat reduction schedule was found to be the optimum when designing new projects because it resulted in the highest discounted net or saleable oil production as shown in Table 3.

Figure 6:
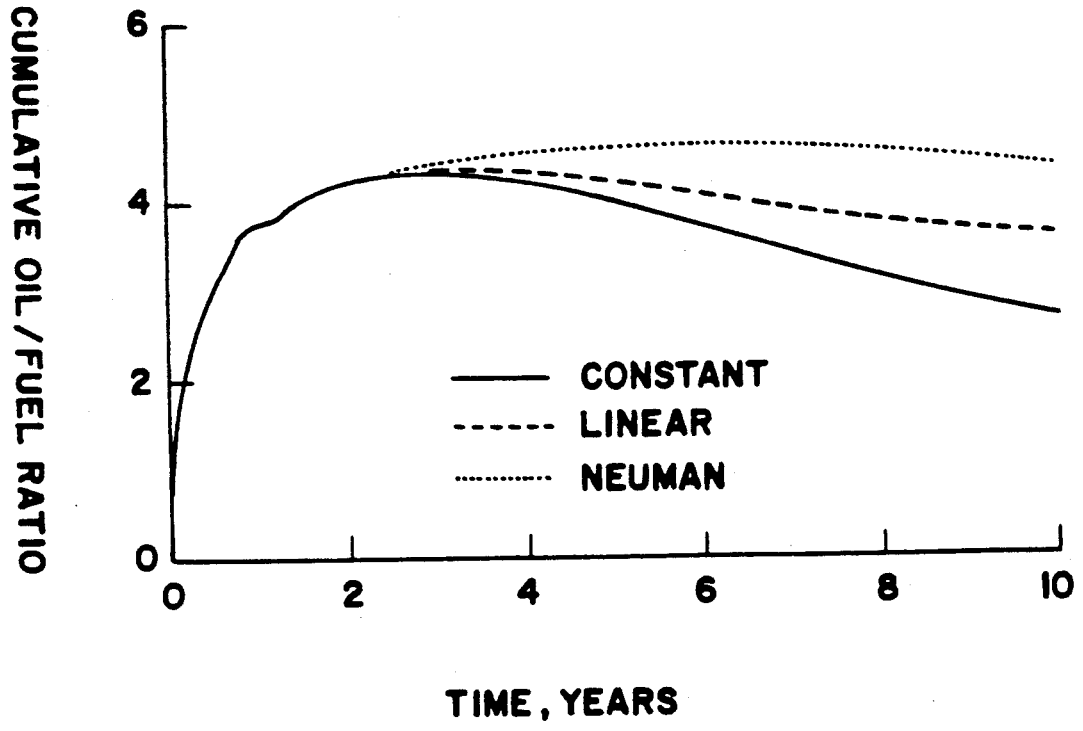
FIG. 6 describes the cumulative oil/fuel ratio for each schedule.

The linear model had a slightly higher discounted net oil production than the constant injection schedule. However, the linear model required a much lower injected steam volume; that is, it utilized the steam generator capacity better. This is also evident from cumulative oil/fuel ratio (OFR) plot in FIG. 6; the OFR for the linear model was higher than the constant. The linear model produced slightly higher amount of net oil with about 20% lower steam volume or generator capacity. The OFR was highest for the Neuman model; however, its discounted net recovery was about 9% lower than the linear schedule.

Table 3 lists three different discount rates. At higher discount rates, the contributions of future production are smaller, resulting in lower net present barrels of oil. Also note that Table 3 lists the net present barrels of oil, which is proportional to the discounted net present value (in dollars) for a flat oil price. For an escalating oil price scenario, the differences between the linear and constant schedules will be higher, and those between the linear and Neuman will be lower compared to the values given in Table 3. This is because, for escalating prices, the delayed production response of linear and Neuman models would have a greater contribution to the net present value.

Figure 7:
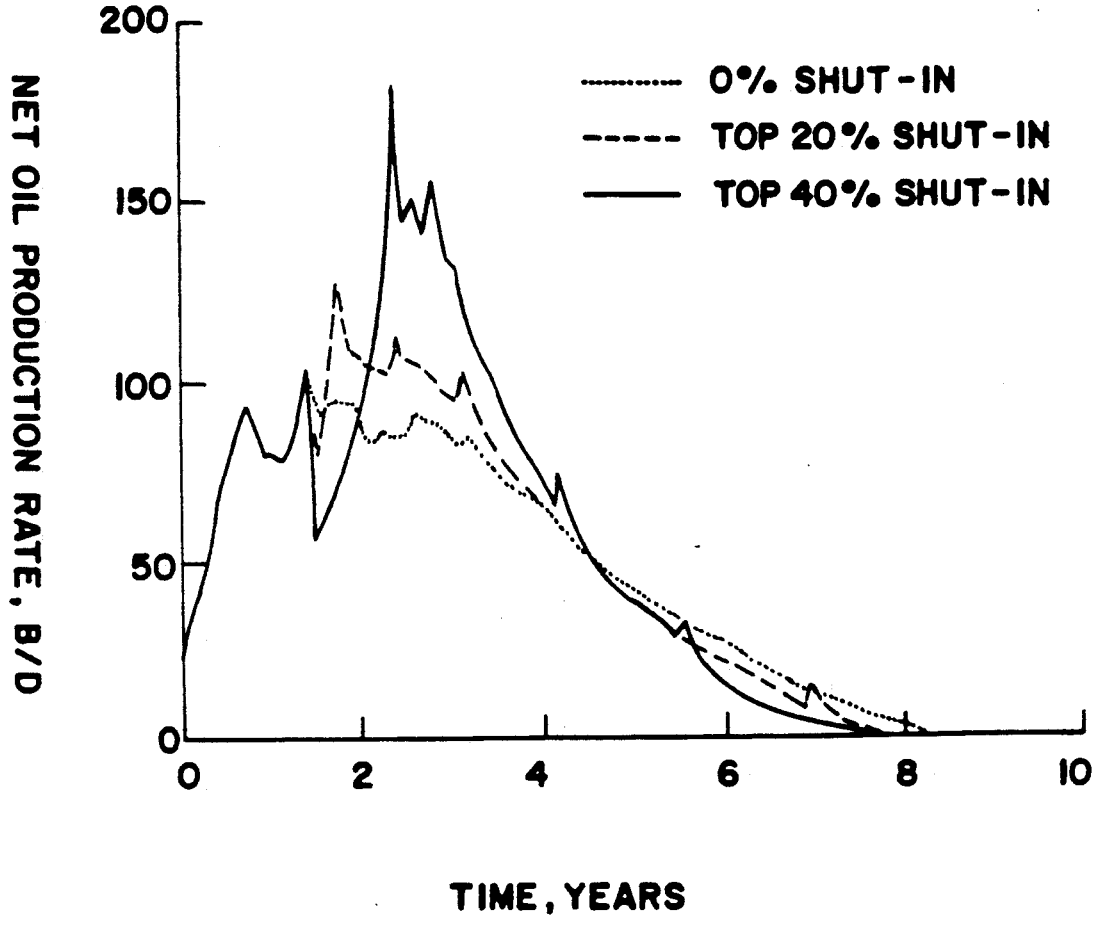
FIG. 7 and FIG. 8 describe partial producer shut-in at constant injection rate.
Figure 8:
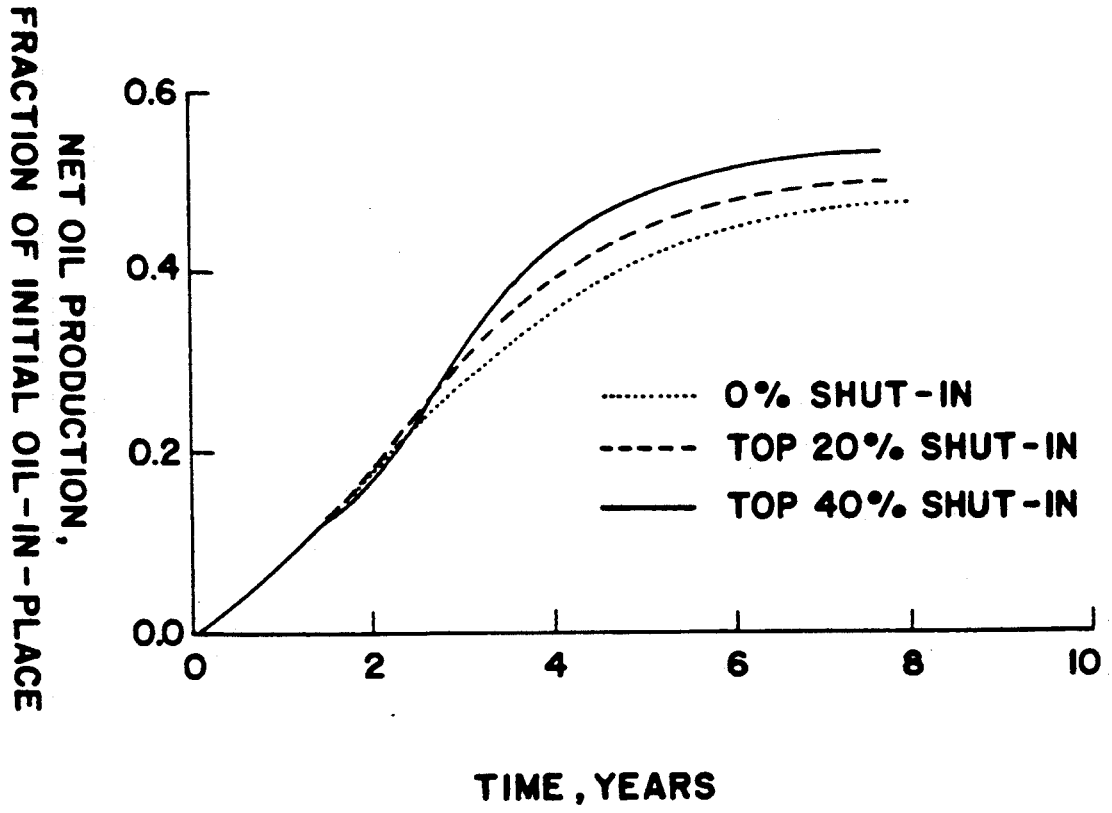

To additionally improve steamflood performance, FIGS. 7 and 8 show that a partial producer shut-in after steam breakthrough, for a constant rate, results in additional recovery compared to keeping the production well open to the entire sand thickness. Immediately after partial shut-in of the producer, the production rate declines somewhat as shown in FIG. 7, as production of the heated oil near the steam override zone is delayed because of the shut-in. Shutting in the top portion of the producer acts as a mechanical diverter of steam to the oil underneath the steam override zone and improves the vertical sweep near the producer. Consequently, the net cumulative recovery increases. Shutting in the top 40% of the producer, while using a constant injection rate, resulted in 9–10% additional recovery.

To verify the results obtained above and to determine their sensitivity to the grid size, runs were made with finer grids near the wells (areal grid size of 7.45 ft. [2.27 m] vs. 29.8 ft. [9.1 m] for the base case). The incremental recovery for partial shut-in was slightly lower for the fine-grid case but the overall results were similar.

Another set of runs was made to simulate what would happen if the cement bond between the reservoir and the casing was not secure. For this case, the fine-grid simulation was used and a very high vertical permeability was assigned to the gridblocks containing the production well. The incremental recovery decreased as the vertical permeability to the production well gridblocks was increased. The discounted incremental recovery for partial shut-in dropped by a factor of two to 4.5%, when the vertical permeability in the production gridblocks was increased to 100 darcy (vs. 2 darcy for the formation).

It is evident that partial shut-in (top 40%) of the producer can result in significant (5-10%) additional recovery with a constant injection schedule. It is also evident that if shut-in is performed after breakthrough, further optimization of steam utilization and greater discounted net oil recovery will result. The actual incremental recovery, compared to when the production well is open to the entire formation, will depend on the bond between the casing and the formation.

Various changes or modifications as will present themselves to those familiar with the art may be made in the method described herein without departing from the spirit of this invention whose scope is commensurate with the following claims:

What is claimed is:

1. A steamflood method for optimizing recovery of petroleum from a subterranean, petroleum containing formation, which is penetrated by at least a first well, and a second well, said wells being spaced apart and having well perforations in fluid communication with a substantial portion of said formation, said method comprising the steps of:

injecting heat into a first injection well at a constant rate until a steam breakthrough occurs in a second producing well, said first and second wells being patterned after a confined reservoir grid system; and reducing said heat injection rate using a linear rate reduction schedule after said breakthrough.

2. The method according to claim 1 wherein the reservoir grid system being patterned is a repeated five spot pattern.

3. The method according to claim 1 wherein heat injection is reduced by a linear reduction in a steam flow rate while maintaining a constant steam quality, said linear reduction based upon the steam breakthrough period and a projected project termination period.

4. The method according to claim 1 wherein heat injection is linearly decreased by a variation in both steam injection rate and steam quality, said linear decrease based upon the steam breakthrough period and a projected project termination period.

* * * * *